United States Patent [19]

Kasdorf

[11] Patent Number: 4,729,282

[45] Date of Patent: Mar. 8, 1988

[54] SHEET DIVERTER FOR SIGNATURE COLLATION AND METHOD THEREOF

[75] Inventor: Kurt H. Kasdorf, Sussex, Wis.

[73] Assignee: Quad/Tech, Inc., Pewaukee, Wis.

[21] Appl. No.: 888,786

[22] Filed: Jul. 22, 1986

[51] Int. Cl.[4] ..... B26D 7/06; B65H 39/10

[52] U.S. Cl. ..... 83/26; 83/105; 83/106; 83/107; 83/102; 271/302; 271/303

[58] Field of Search ..... 83/102, 105, 106, 107, 83/344, 503; 271/118, 119, 304, 303, 302

[56] References Cited

U.S. PATENT DOCUMENTS

| | | | |
|---|---|---|---|
| 4,008,891 | 2/1977 | Buys | 271/303 |
| 4,322,069 | 3/1982 | Mitchell | 271/302 |
| 4,373,713 | 2/1983 | Loebach | 83/105 |
| 4,615,518 | 10/1986 | DiBlasio | 271/118 |

FOREIGN PATENT DOCUMENTS

| | | | |
|---|---|---|---|
| 0089407 | 9/1983 | Fed. Rep. of Germany | 271/303 |

*Primary Examiner*—E. R. Kazenske
*Assistant Examiner*—Scott A. Smith
*Attorney, Agent, or Firm*—Foley & Lardner

[57] ABSTRACT

A sheet diverter, adapted for cooperative association with a cutter in a pinless folder assembly for a high speed printing press, wherein a ribbon is cut into a plurality of signatures destined for serially deflected parallel collation from a diverter path through the sheet diverter to a desired one of a plurality of collation paths to systematize the order of the signatures into a selected array, is comprised of an oscillating diverter guide member reciprocating in a diverter plane having a component generally normal to the diverter path of a signature through the guide member, for directing the lateral disposition of the leading edge of the signature into engagement with a diverter member separating a plurality of collation paths, each having a throat for receiving a selected signature and merging to a confined course for guiding it, the diverter member including a diversion surface disposed in each of the throats lying at a diversion angle respecting the travel of the signature from the oscillating guide member, the diverter member directing the leading edge of the signature and controlling its course through the throat into the collation path.

26 Claims, 3 Drawing Figures

SHEET DIVERTER FOR SIGNATURE COLLATION AND METHOD THEREOF

TECHNICAL FIELD

The present invention relates, generally, to sheet diverters for directing selected web segments moving in serial fashion along a path to one of a plurality of collation paths and, more especially, to a high speed sheet diverter of the foregoing ilk for collation of printed signatures in the binding of a publication such as a magazine or a newspaper. The present invention further relates to methods for collating webs segments, such as signatures from a high speed press.

DESCRIPTION OF THE BACKGROUND ART

Sheet diverters of all manner and variety are, of course, well known in the art. The same may range from the collating apparatus associated with an office copier, to sheet or web handling devices employed in the manufacture of paperboard articles, to sheet diverters specifically adapted to collate signatures in binding or otherwise assembling books, magazines or newspapers. Each of these environments presents a somewhat different challenge in designing an efficient diverter or collator, but the same objective tends to dominate the entire class of apparatus—accurately routing selected flexible webs or ribbon sections along a desired collating path to achieve the desired order of, e.g., pages is paramount.

In situations where the apparatus is of low or moderate speed, such as an office copier, design options are relatively straightforward. However, increasing speed has tended to be a limiting factor on the efficiency of sheet diverters or collators. Considering, for example, the physical qualities of paper or similar flexible webs moving at high speeds, relatively slight imperfections can be magnified, causing whipping, "dog-earring," or bunching of the paper web and ultimately contributing to a jam somewhere in the apparatus. Jams are cleared only by taking the device out of service and manually retrieving ruined product. The associated production delays and waste have severely handicapped the evolution of yet faster production techniques. For example, timing in a printing press operating at 700 to 800 feet per minute has proven to be readily achievable; conventional manufacturing techniques and tolerances are capable of providing accurate collation of signatures through sheet diverters and relatively reliable operation. The next incremental speed increase, to about 1,500 feet per minute, has been accomplished with some difficulty as rotational speeds rise and tolerances become significantly more important. Rotary elements moving at these higher angular velocities yield surface speeds at rotating rolls or cylinders which increase proportionately while inertial effects become quite pronounced. Tolerances must be held closely and timing controlled critically. The further advance to speeds over 2,000 feet per minute, and preferably over 2,500 feet per minute, is accompanied by the greatest of difficulties when all of these factors are borne in mind. To date, the art has not responded adequately to the needs for a sheet diverter which can efficiently collate signatures from a printing press at speeds in excess of 2,000 feet per minute while minimizing tendencies toward tearing or bunching of fast moving signatures and resultant machine jamming.

Other factors have also troubled the design of sheet diverters, particularly those employed in the printing industry. A conventional design which has thoroughly permeated the printing industry is a folder/sheet diverter which conveys signatures on a plurality of pins or other similar members which pierce the paper to grasp it and thence transport it throughout the apparatus. For most publications, with the exception of some newspapers, the marginal area through which the pins project must be trimmed as part of normal production techniques. On the one hand, this creates an additional manufacturing step and contributes to increased costs of production; on the other hand the approximately ¼ inch strip cut from the bound signatures is waste which is costly in terms of the added expenses of procurement and disposal. Consequently, the art has sought to provide so-called pinless folders which overcome those historical problems. A certain level of success has been achieved considering designs which operate well at the lower press speeds, for example, less than about 1,000 feet per minute. At higher speeds the problems summarized above begin to dominate the situation. Particular shortcomings may be noted for pinless folders which ar pushed to operate at speeds perhaps beyond their design limits where there is a lack of structure or other functional provision to ensure positive control and transport of the signature as it progresses through the stations of the folder/diverter/collator. That function, formerly provided by the pins pierced through the web to restrain it during its travel, is an important one not fully accommodated by many commercial pinless folders.

An interesting diverter design is disclosed in U.S. Pat. No. 4,373,713. The diverter mechanism is comprised of a pair of counterrotating diverter rolls bearing specifically configured camming surfaces cooperating with a diverter wedge or plate disposed immediately downstream of the nip created by those rolls. That wedge, in the nature of a triangular member, defines two paths, one of each along the angled surface from its apex. As a signature reaches the nip of the cooperative diverter rolls it will encounter a cam surface on one or the other which will direct the leading edge of the signature to one or the other side of the diverter wedge. Programming capabilities may be achieved by the user to select, for example, two signatures for diversion on one side of the wedge and then one on the other, by judicious placement and design of the camming surfaces.

High speed operation of a diverter mechanism such as that disclosed in the '713 patent is problematic. The raised cam elements at the outer periphery of the rotating rolls will tend to cause vibration as the angular velocity of the rolls increases to the realm of interest with regard to the sheet speeds (surface velocities) anticipated by the present invention, up to about 2,500 feet per minute. While, of course, the rotating rolls can be counterbalanced for dynamic operation, it is not at all clear that the design would tolerate those types of speeds even under the best of circumstances and efficiently divert the fast-moving signatures into one or the other of the desired collation paths. In short, that approach is not viewed as workable in light of the high speeds sought to be attained nor is it seen to be particularly reliable in reducing jamming tendencies which are expected to arise in these settings.

A conceptually similar design, albeit for substantially lower speeds and different types of materials, is the one found in U.S. Pat. No. 3,391,777. That device is tailored to divert flexible batts such as those utilized in the manufacture of disposable diapers or sanitary napkins. The batts are confined between pairs of belts moving toward a rotating disc having a generally semicircular "cam" surface. The disc is thus composed of a first segment of a short radius and a second segment of a large radius. Two deflection paths are associated with the moving disc which directs first one batt and then the next to one of the two paths; a first path is provided coincident with the shorter radius while a second path is provided coincident with the larger radius. Coordinating the rotational speed of the disc with the linear travel of the belts and batt, the leading edge of the latter will encounter the surface corresponding to one or the other of the radii and be directed to the corresponding path. This diverter, like the one mentioned above, is limited in its applicability to collate flexible web members as speeds increase substantially.

U.S. Pat. Nos. 3,218,897 and No. 3,565,423 are of background interest insofar as each concerns apparatus for conveying and stacking flexible sheets such as paper sheets. Each of the apparatus disclosed in those patents includes a diverter gate or the like which controls the direction of paper flow along one of two paths. A principal path is fed while means are provided to scan or otherwise examine the paper. In the event a defect is detected requiring rejection of a sheet, the diverter gate is activated and directs that sheet along a second path.

The blanking machine of U.S. Pat. No. 2,164,436 is of general interest for its disclosure of a distributing roll set for directing components in the blanking of a paperboard box. Aligned notches in deflecting discs receive cards and distribute them along separate paths. Each of the discs is eccentrically notched or shouldered and carries a cam finger. As the distributing rolls rotate, the cam finger of one roll will always be presented to the notch of the opposing roll, thus deflecting successive blanks first upwardly and then downwardly from the horizontal plane of the line of bight between the rolls. The upward or downward course thus initiated is maintained by a wedge-shaped deflector, disposed with the apex directed into the bight between the rolls; the downwardly deflected blank must pass beneath the wedge while the upwardly defected blank must pass above it. Once again, the depending structure, in this case the cam finger, precludes attainment of substantial speeds under reliable and efficient conditions.

From the foregoing, it is evident that the art has yet to respond with a pinless folder/sheet diverter capable of operating in concert with a high speed press at paper speeds significantly in excess of 2,000 feet per minute and reaching 2,500 feet per minute or more. Thus, the need for such a device is a felt one, to which the present invention responds.

SUMMARY OF THE INVENTION

The present invention advantageously provides an efficient sheet diverter for a pinless folder which operates at high speeds, i.e., at paper speeds in excess of 2,000 feet per minute and preferably in excess of 2,500 feet per minute, with reduced jamming tendencies and high reliability. The sheet diverter of the present invention is noteworthy for an elegance of design simplicity which contributes to operational efficiency, lower and fewer periods of downtime, and convenient serviceability.

The foregoing advantages are realized, in one aspect of the present invention, by a sheet diverter adapted for cooperative association with a cutter in a pinless folder assembly, wherein a ribbon is cut into a plurality of signatures destined for serially deflected parallel collation from a diverter path through the sheet diverter to a desired one of a plurality of collation paths to systematize the order of the signatures into a selected array, comprising an oscillating diverter guide means reciprocating in a diverter plane having a component generally normal to the diverter path of a signature through the guide means, for directing the lateral disposition of the leading edge of the signature away from the static centerline of the diverter path; and diverter means separating a plurality of collation paths, each having a throat for receiving a selected signature and merging to a confined course for guiding the same, the diverter means including a diversion surface disposed at each of the throats lying at a diversion angle respecting the centerline for receiving the leading edge of a signature selectively directed thereto by the diverter guide means and controlling the course of the signature through the throat into the collation path. The guide means are preferably comprised of a pair of diverter rolls journalled for rotation about axes lying in the diverter plane, and more preferably a pair of counterrotating eccentric diverter roll which oscillate linearly within the diverter plane defined by the axes of those rolls.

The sheet diverter of the present invention ideally includes signature control means for restraining confinement of the signature throughout its course within the apparatus along the diverter path and into a selected one of the collation paths. The signature control means are most preferably comprised of primary signature control means upstream of the diverter guide means and secondary signature control means downstream of each of the throats. The respective control mean are disposed so that the linear distance through the diverter between the primary signature control means and each of the secondary signature control means is less than the length of the signature to be diverted through the apparatus, whereby the appropriate secondary signature control means assumes control of the leading edge of the signature prior to the primary signature control means releasing control of the trailing edge of that selfsame signature. Accordingly, positive control of the signature throughout the procedure is maintained, equivalent to or exceeding that of the older pin-type folders.

The signature control means preferably include primary, diverter belt means disposed over roll means, including at least one drive roll, into operative engagement with the diverter rolls to comprise the diverter path. Secondary, collator belt means are disposed over roll means, including once again at least one drive roll means, and cooperate with the diverter belt means downstream of each of the throats to comprise the individual collation paths. Advantageously, each of the primary and secondary signature control means includes a soft nip between associated rolls guiding the belts. More specifically, the primary signature control means is ideally comprised of a soft nip between a superior roll and abaxially disposed inferior roll between which the diverter belt means pass upstream of the diverter rolls. Likewise, each of the secondary signature control means is preferably comprised of a soft nip between a superior roll and an abaxially disposed inferior roll between which an associated one of the collator belt means passes in cooperative engagement with a diverter belt means to define in part the collation path. Most preferably, each of the belt means employed in the instant apparatus is comprised of a segmented belt means as has heretofore been generally customary in these devices.

The sheet diverter of the present invention operates in its preferred environment adjunct to a cutter, typically comprised of a pair of counterrotating cutting cylinders. The cutter subdivides a generally continuous ribbon into a plurality of discrete signatures and conventionally does so without the removal of material between successive signature members. Preferably, to allow adequate time for the diverter guide means to shuttle in its reciprocating course to direct successive signatures to appropriate collation paths, some measure of physical separation between consecutive signatures is desirable. The sheet diverter of the present invention advantageously accelerates the signature as it is cut, advancing the trailing edge of one signature from the leading edge of the next ensuing signature which is retained within the cutter section. Most preferably, this is achieved by creating an instantaneous increase in angular velocity of the eccentric rolls, greater than the velocity of the ribbon into the cutter, whereby the cut signature is accelerated to yield a controllable separation or gap between successive signatures. In a highly preferred embodiment, the diverter rolls are driven synchronously with the cutting cylinders in order to attain proper timing. In that event, the acceleration of the signature is most preferably achieved by timing the cutting of the signature with the throw or stroke of the eccentric travel of the diverter rolls, the cutting of a signature corresponding to the maximum linear displacement of the eccentric travel in the plane of movement. The creation of this acceleration force is accommodated in the structure of the diverter rolls themselves, which include an idling outer sleeve journalled for independent relative rotation about the drive shaft of the diverter roll.

Once the signature which has been cut from the ribbon is grasped within the primary signature control means and directed through the reciprocating diverter rolls, the leading edge is introduced into a desired one of a plurality of throats for proximate contact with the diverter means. The diverter means is preferably comprised of a diverter wedge means having an apex directed toward the linearly reciprocating bight of the diverter rolls immediately upstream of the juncture of the collator and diverter belts as summarized above. A first throat region is defined between a first sloping diversion surface of the wedge and a diverter belt, while a second throat region is defined between a second sloping diversion surface of the wedge and another diverter belt. The throat regions open and close as the diverter rolls reciprocate in the diverter plane and thrust the diverter belt means toward and away from those diversion surfaces.

The diverter guide means ideally directs the lateral disposition of the leading edge of the signature into a desired one of the throats and into engagement with the appropriate diversion surface at a point lying along its length within about the upper one-third of the distance from the apex. From there the signature progresses through the throat and into the secondary signature control means which ensures positive transport of the signature along the collation path. Those collation paths receive successive signatures moving at sheet speeds up to about 2,500 feet per minute or more and yet accurate and efficient collation with reduced jamming tendencies are provided.

Other advantages, and a fuller appreciation of the structure and operation of the present invention, will be gained upon an examination of the following detailed description of preferred embodiments, taken in conjunction with the figures of drawing.

DETAILED DESCRIPTION OF PREFERRED EMBODIMENTS

The present invention relates, generally, to sheet diverters or collators which direct flexible web materials from a diverter path to one of a plurality of collation paths in order to assemble a systematized array of such webs and, more specifically, to a sheet diverter of this sort for collating or otherwise diverting signatures from a high speed printing press in assembling a printed publication such as a magazine, a newspaper or the like. Accordingly, the invention will now be described with reference to certain preferred embodiments in the foregoing contexts; albeit, those skilled in the art will appreciate that such a description is meant to be exemplary only and should not be deemed limitative. For example, the principles of the present invention are equally adaptable to the high speed collation of printed or photocopy pages as may be prepared on a photocopy machine, the diversion of flexible (i.e., non-rigid) webs of material in manufacturing processes where the direction of components from a mainstream to a plurality of individual routes is desirable or otherwise advantageous, and suchlike.

Figure 1:
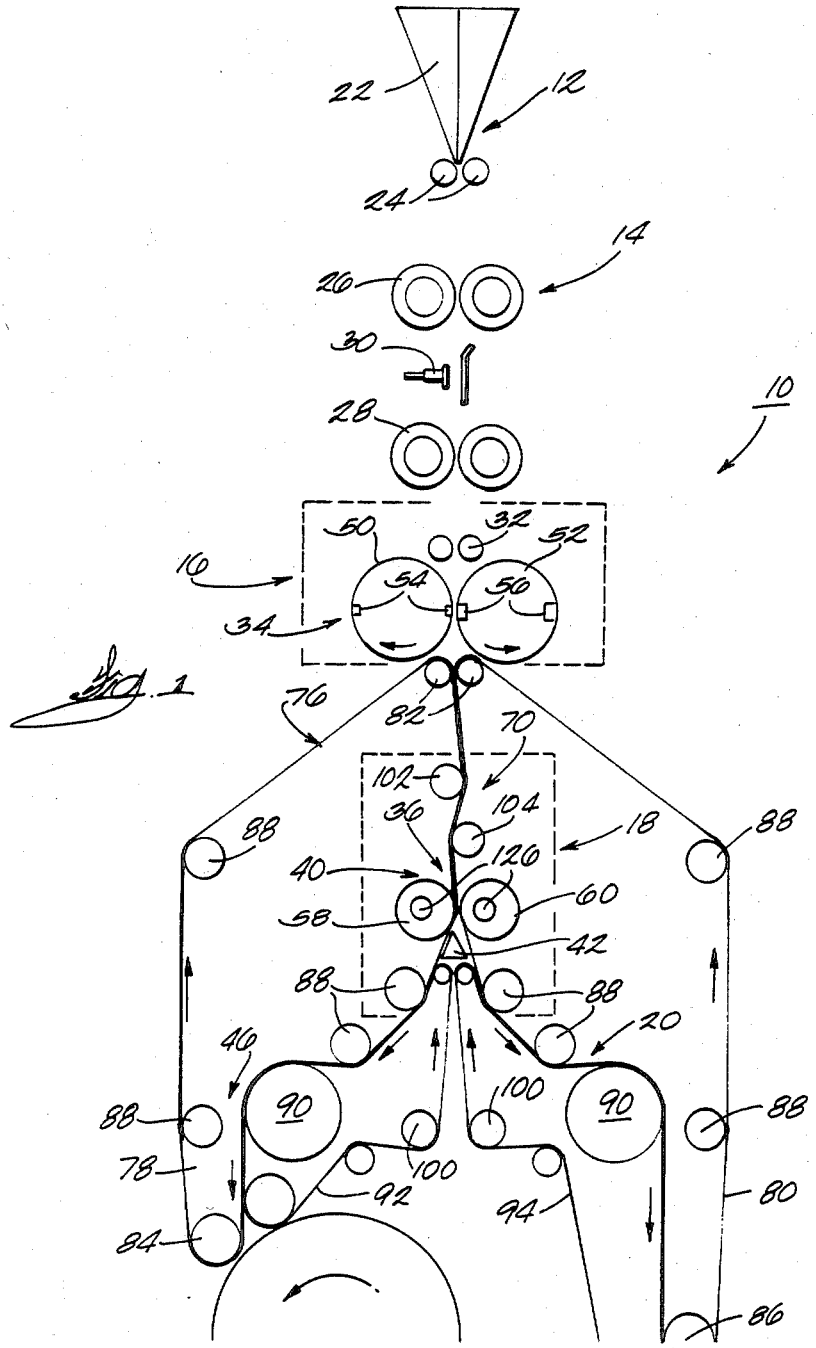
FIG. 1 is a highly diagramatic view of a pinless folder, a generally conventional forming board and associated drive and cutting sections, incorporating a sheet diverter in accordance with the present invention.

Turning to the figures of drawing, in each of which like parts are identified with like reference characters, FIG. 1 illustrates in a highly diagramatic fashion a portion of a high speed printing press which forms, folds, and collates printed signatures, which apparatus is designated generally as 10. The apparatus 10 is comprised of a forming section designated generally as 12, a driving section designated generally as 14, a cutting section designated generally as 16, a diverting section designated generally as 18, and a collating section designated generally as 20. The forming section 12 is comprised of a generally triangularly shaped forming board 22 which receives a longitudinally slitted web, termed at the stage of the printing process a "ribbon" and folds the same. The folded ribbon is thence fed downwardly under the influence of a pair of squeeze rolls 24 by the drive section 14. The drive section is shown to be comprised of pairs of upper and lower drive rolls, 26 and 28 respectively. These drive rolls transport the ribbon proximate a charging unit 30 which applies a charge of static electricity to the travelling web to keep the paper leafs together. The ribbon next encounters conditioning rolls 32 in the cutting section through which it passes into engagement with a cutter means 34. The ribbon is segmented by the cutter means 34 into a plurality of approximately page-length segments, each of which is termed a "signature." Successive signatures enter the diverting section 18 along a diverter path designated generally as 36. The signatures are led to a sheet diverter, designated generally as 38, which is comprised of oscillating diverter guide means designated generally as 40 and diverter means designated generally as 42. The diverter means 42 deflects a signature to a selected one of a plurality of collation paths, two of which are shown in FIG. 1 and identified generally as 44. At that juncture the signature enters the collating section 20 and is fed along a respective one of the collation paths to a desired destiny, here illustrated as fan delivery members 46 associated with conveyor means 48.

Dealing more specifically with the components which comprise the apparatus 10, the cutting means 34 of the cutting section 16 are most preferably comprised of a pair of counterrotating cutting cylinders 50 and 52. One cylinder is fitted with a pair of cutting knives 54 while the other is formed with a pair of cutting recesses 56. Since the cylinders include pairs of knives and opposed recesses, two cutting actions are achieved per cylinder rotation. The knives and recesses are disposed so that the former on a first cylinder projects interiorly of the latter on the cooperating, associated cylinder thereby piercing the ribbon and creating a segment or signature. Typically, the knife is a serrated-edge knife which cuts the ribbon without substantial removal of material from the ribbon, severing the paper web and separating the signature thus formed from the ribbon by approximately the thickness of the blade. Suitable timing means, known to those of ordinary skill in the art, provide accurate registration of the cutter vis-a-vis the ribbon to assure the appropriate cut dimensions for the signature. From there, the signature is delivered to the diverter section 18 of the apparatus, which forms the core of the present invention.

The diverting section includes the diverter 38 which is comprised of the oscillatinq diverter guide means 40 and the diverter means 42. The diverter guide means directs the lateral disposition of the leading edge of the signature relative to the diverter means which separates a plurality of collation paths. The oscillating diverter guide reciprocates in a diverter plane which has a component, and preferably the principal component, generally normal to the diverter path 36. The structure of this diverter is best viewed in FIG. 2.

The diverter guide means 40 are most preferably comprised of a pair of diverter rolls identified generally as 58 and 60, described in greater detail below. These rolls are journalled for rotation about axes lying in the diverter plane, identified A—A in FIG. 2. As shown in the figures of drawing, the diverter rolls 58 and 60 are counterrotating eccentric rolls which are associated to create linear reciprocation of a diverter nip 62 which lies between the two rolls 58 and 60. The nip 62 is preferably dimensioned to be oversized to avoid exerting any compressive force on a signature travelling through the diverter in the sense that, all other things being equal, a signature can be drawn through the nip 62 without rotation of the rolls. The diverter nip reciprocates along a line lying in, and indeed generally defining, the diverter plane when taken in conjunction with the axes of those cylinders. In other words, rotation of the eccentric diverter guide rolls 58 and 60 shuttles the diverter nip leftward and rightward as best envisioned with reference to the phantom lines of FIG. 2. Accordingly, a signature, such as the signature 64, will have its leading edge 66 moved leftward or rightward depending upon the throw of the oscillating guide means 40 for ultimate proximate contact with the diverter means 42, as described in greater detail hereinbelow. Thus, over its reciprocating travel, the diverter illustrated in FIG. 2 will first pass a signature, such as the signature 68, along one of the collation paths 44 and then another signature, such as the next successive signature 66, along another of the collation paths 44.

The signatures to be collated by the apparatus of the present invention, such as the signatures 66 and 68, are routed throughout their paths under the positive influence of signature control means for restraining confinement of those signatures along the diverter path and into a selected one of the collation paths. In the embodiment illustrated in FIG. 2, these signature control means are comprised of a primary signature control means 70 upstream of the diverter and within the diverter path 36 and secondary signature control means 72 and 74 downstream of the diverter and associated, one of each, with a collation path 44. The linear distance through the diverter between the primary signature control means 70 and the appropriate one of the secondary signature means such as 72 and 74 is less than the length of the signature to be diverted through the apparatus. Accordingly, the selected secondary signature control means, based upon the diversion path into one or another of the collation paths, assumes control of the leading edge of the signature prior to the time the primary signature control means 70 releases control of the trailing edge of that self-same signature, recalling that the diverter guide means themselves exert no compressive control over the signature being diverted thereby. Consequently, the signature is positively guided by these primary and secondary control means through the diverter section and into the desired collation path without loss of restraining control over it. Amongst other advantages this positive approach to control provides, there are fewer tendencies toward jamming and dog-earing or similar creasing of the paper web comprising the signature to be diverted.

Figure 2:
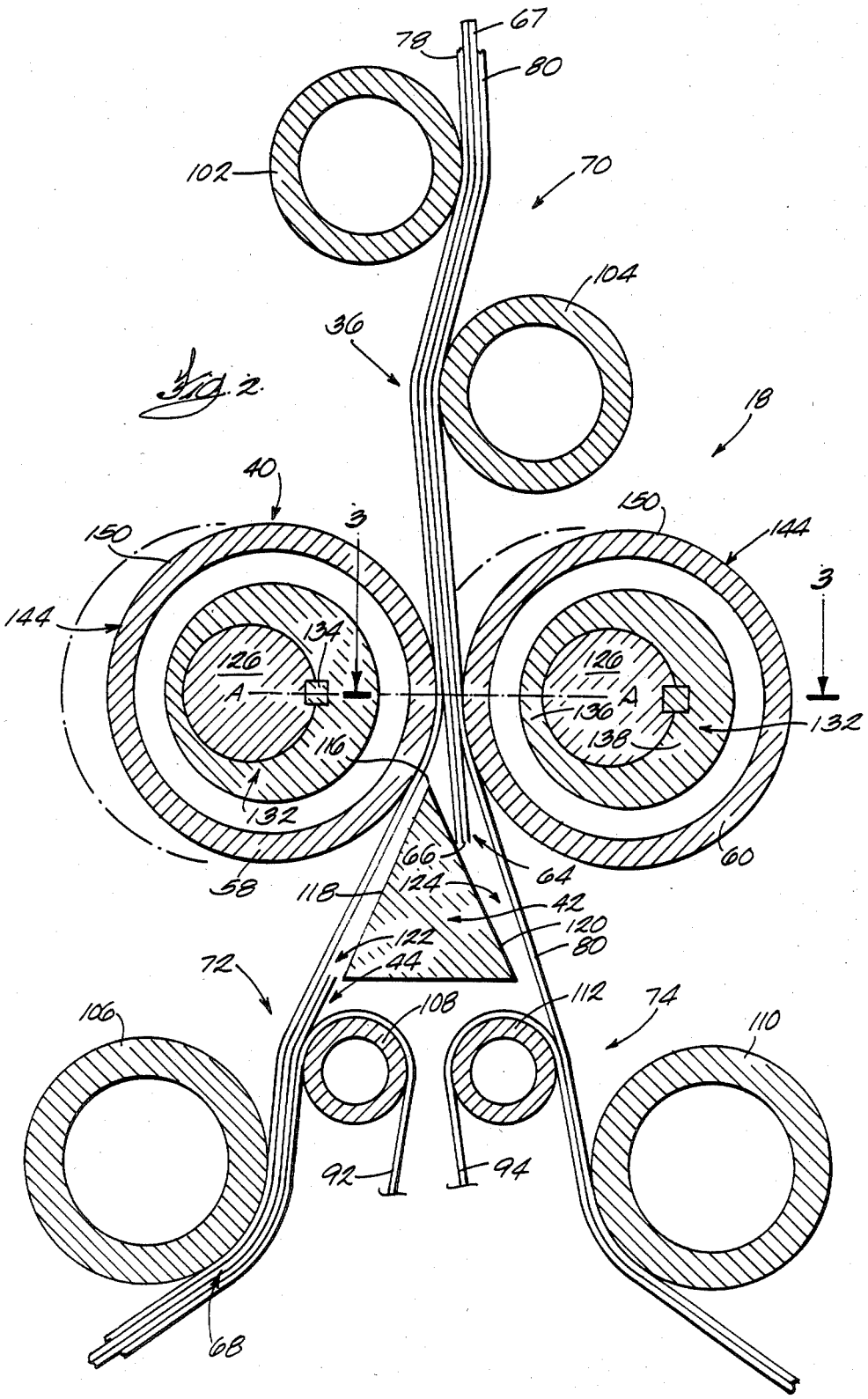
FIG. 2 is a sectional view through the diverter and guide sections of a sheet diverter in accordance with the present invention, showing in phantom lines the manner in which the preferred form of guide member reciprocates to direct a signature first to one collation path and thence to another distinct collation path; and, FIG. 3 is a sectional view, taken substantially along the line 3—3 of FIG. 2, and here showing the construction of eccentric diverter rolls which comprise the most preferred form of guide means for the sheet diverter of the present invention.

The primary and secondary signature control means shown in FIG. 2 are advantageously comprised of belts, and most preferably segmented belts, disposed over roll means, including at least one drive roll, into a endless belt configuration best viewed in FiG. 1. More specifically, a primary or diverter belt means, designated generally as 76, is comprised of first and second diverter belts 78 and 80, respectively. The two diverter belts which constitute the diverter belt means 76 circulate in separate continuous loops, being joined at a nip between a set of belt idler rolls 82 proximate the outfeed of the cutting section 16 and thence cooperating to define the diverter path 36 through the diverting section 18. Drive rolls 84 and 86 drive the belts 78 and 80, respectively, about idler rolls 88. The diverter belts are driven over guide rolls 90 in each of the paths of the diverter belt means which have considerably larger diameters than the idler rolls 88. These guide rolls 90 are sized and positioned to reduce tendencies for the signatures to crease along the backbone during transport through the collation paths, a result attributable to a larger radius of curvature at the zone where the signature takes a relatively sharp turn toward the fan delivery members of the collating section. In other designs, where similar sharp turns are required to be negotiated by the signatures, similar means to preclude creasing of the backbone advantageously will be incorporated.

In the same fashion, collator belt means are comprised of a first collator belt 92 and a second collator belt 94. The collator belts share a common path with the diverter belts along the collation paths 44 beginning downstream of the diverter means 42, upstream of which the diverter belts themselves diverge. The collator belts are driven by drive rolls 96 and 98 and circulate in conjunction with certain of the idler rolls 88 where the collator and diverter belts coincide along the collation path, as well as idler rolls 100 which are disposed interiorly of the collation path in the endless loop of these belt members.

The signature control means described above comprise the diverter and collator belt means in concert with specially configured soft nips disposed at appropriate locations along the diverter and collator paths. As best viewed in FIG. 2, the primary signature control means 70 is illustrated as a soft nip defined by a superior roll 102 and an inferior roll 104 disposed abaxially with respect thereto. The rolls 102 and 104 thus compress the diverter belts 78 and 80 as the same follow the diverter path 36 through the somewhat skewed or canted route of the soft nip between these two roll members. This soft nip compressively captures a signature, such as the signature 64, during the time it traverses the diverter path. Variations in thickness or other irregularities are not merely tolerated but actively accommodated by means of this generally self-regulating compressive nip. Furthermore, problems such as whipping of the signature, the creation of standing waves in the moving belts or similar feed irregularities are minimized by utilizing this soft nip approach as compared, for example, to hard nips of the variety conventionally installed in diverter apparatus. Irrespective of such considerations, each of the secondary signature control means is likewise comprised of a soft nip for compressively capturing signatures as the same enter the collation paths 44. More specifically, the secondary signature control means 72 is comprised of a superior roll 106 operating in concert with an abaxially disposed inferior roll 108, capturing within the soft nip between these cooperative rolls the diverter belt 78 and collator belt 92. Likewise, the secondary signature control means 74 is comprised of superior roll 110 operating in concert with abaxially disposed inferior roll 112 to capture the diverter belt 80 and collator belt 94 for that collation path. Signatures moving through either of these nips will thus do so under the influence of the compressive control forces exerted thereby.

The sheet diverter of the present invention routes a signature (e.g., 64) to an appropriate one of the collation paths by placement of the leading edge of that signature (i.,e., 66), into appropriate proximate contact with the diverter means 42. The diverter means 42 is shown in this illustrative embodiment to comprise a diverter wedge 114 having a generally triangular cross-section including an apex 116 which is oriented toward the diverter nip 62 and from which diversion surfaces 118 and 120 taper downwardly toward the collation paths. Most preferably, the diverter wedge has the cross-section of an isosceles triangle with base angles of about 25 to provide a proper or desirable pitch for the moving signature as it encounters the sloping diversion surfaces. Throat regions 122 and 124 are formed between the tapered diversion surfaces of the wedge 114 and the diverter belts. More specifically, a first throat 122 is formed between the diversion belt 78 and the sloping diversion surface 118; the throat 124 is provided between the diversion belt 80 and the sloping diversion surface 120. As the diverter guide means 40 reciprocate in the diverter plane, the leading edge of the signature is caused to enter one or the other of the throats 122 or 124. The lateral disposition of the reciprocating guide means 40, and hence diversion nip 62), is timed relative to the downward path of the signature so that the leading edge strikes the diversion surface at a point lying approximately within the upper one-third of that surface, preferably within the upper one-quarter, measured from the apex 116.

As is best visualized with reference to FIG. 2, the throats 122 and 124 tend to open and close as the guide means reciprocate, thrusting the diverter belts toward or away from the diversion surfaces of the wedge 114. The diverter rolls are shown in the figures to be cycled to a rightward position, directing the signature 64 into the open throat 124 which results from movement of the diversion belt 80 away from the diversion surface 120. Simultaneously, that rightward translation of the diverter rolls from the position shown in phantom thrust the diversion belt 78 toward the diversion surface 118, tending to close the throat region 122 following passage of the signature 68. Along these lines, it should be appreciated, however, that neither throat closes completely, with the diversion belt actually contacting the wedge, for several reasons: the diversion surfaces are highly polished, to a surface finish preferably in the range of from about 8 to about 12 microns, and contact by the belt would mar that surface; it is also advisable to preclude any pinching tendency at or about the trailing edge of the signature as it exits the throat region, allowing the signature to pass freely along the collation path without any hesitation, in part the same motivation for oversizing nip 62.

From the foregoing, it will be apparent to those skilled in the art that the path lengths between the primary signature control means 70 and the secondary signature controls means 72 and 74 will vary during the diverting procedure due to the movement of the diverter guide means 40 and the opening and closing of the throat regions. For example, in the most preferred embodiment of the present invention, each of the eccentric diverter rolls 58 and 60 is designed to be approximately one-quarter inch off axis, to yield a full eccentric throw of about one-half inch. The flexible diverter belts 78 and 80 are segmented belts typically about 0.047 inches in thickness in order that the belts may yield or be compressed as the oscillating guide means reciprocate over this throw or limit of travel in the diverter plane. A length change of the belts in the range of from about 1 to about 2% is anticipated for a sheet diverter collating conventional magazine-size signatures under such circumstances. More specifically, and in accordance with the foregoing admonition that the linear distance between primary and secondary signature control means should be less than the length of the respective signature in order to maintain positive control during the procedure, the following dimensions are given as exemplary of a highly preferred embodiment along these lines. When the diverter guide means 40 is at its rightwardmost position, as shown in FIG. 2, the linear distance measured along the belt 80 from the exit of the soft nip 70 (point A) to the point of entry at soft nip 74 (point B) is 8.2735 inches, whereas the linear distance from the point of exit from soft nip 70 (A) to the exit of soft nip 74 (point C) is 10.0030 inches. When the diverter guide means occupies the leftwardmost throw of its travel, the linear distance along the belt 80 from reference point A to reference B is 8.3704 inches, whereas that distance between the reference points A and C is 10.1971 inches. Accordingly, the length change between the points A and B as the diverter guide means reciprocates along its path is 0.0969 inches or 1.171%, while the length change over the distance A to C is 0.1940 inches or 1.1939%. This variation in belt length is accommodated by the resiliency of those belts, conventionally manufactured from a natural or synthetic polymer of sufficient resiliency to tolerate the stretching without undue wear or fatigue.

The resiliency of the belts, particularly the belts 78 and 80, also contributes to the ability of the sheet diverter to provide adequate separation between successive signatures as they are formed on the cutter 16. There must be a gap between the trailing edge of a signature, as it moves along the diverter path into an appropriate collation path, and the leading edge of the next successive signature to permit the throw of the guide means 40 to direct the signatures to the proper paths. Creating a sufficient separation to facilitate timing is a significant aspect of the present invention insofar as the linear speed of travel may well exceed 2,000 feet per minute through the sheet diverter and this must be accommodated without undue tendencies for jamming or misque, delivering signatures to the wrong collection locations. A gap is created between consecutive signatures by accelerating a signature as it is formed on the cutter, rapidly pulling it away from the ribbon yet to be cut. Preferably, this is achieved by establishing an instantaneous speed increase of about 10–13% in the diverter section compared with the ribbon speed through the cutter section. In turn, the velocity increase is most preferably coordinated by timing the cutter cylinders 50 and 52 with the throw of the diverter rolls 58 and 60, ensuring that a signature is cut when the diverter rolls are at an extreme left or right position, having distended the belts to the maximum degree. Appropriate timing is most preferably achieved by slaving the rotation of the shafts driving the diverter rolls with those shafts driving the cutting cylinders. Yet, by virtue of that direct drive, it is necessary to adapt the structure of the diverter rolls to tolerate the faster speed of the belt through that section or risk wear of those belts at a rapid and otherwise intolerable rate—it is projected that a commercial sheet diverter for a high speed web press would wear out a set of belts in about six hours were suitable provisions not made.

Figure 3:
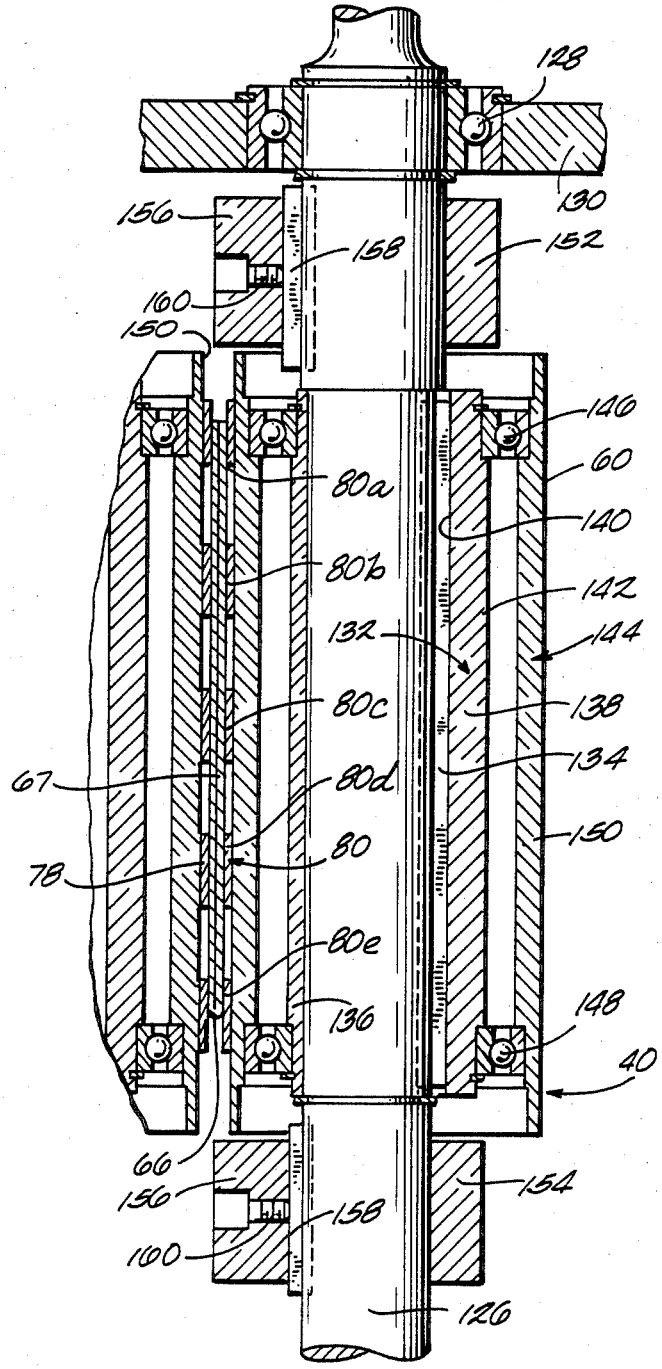

The structure of the diverter rolls, best viewed in FIG. 3, provides means for eccentric rotation with increased peripheral angular velocity as compared with the angular velocity of the shaft driving that roll. A shaft 126 is journalled for rotation in bearings 128 disposed in stanchions 130. (Typically a plurality of sheet diverters will be stacked to receive a number of signatures from various ribbons, although only one such diverter roll section is shown in FIG. 3 for the sake of clarity.) The shaft 126 is fitted with an eccentric sleeve 132 which is secured by means of a key 134. The eccentric sleeve 132 is shown in FIG. 3 to have a thinner section 136 and a thicker section 138 defined between an inner surface 140 and an outer surface 142. The inner surface 140 is dimensioned to provide a close fit with the circular shaft 126 which, in combination with the key 134, provides coincident rotation of the sleeve with the shaft. An outer sleeve 144 is disposed concentrically about the eccentric sleeve 132, this outer sleeve 144 having a uniform thickness in contradistinction to the eccentric sleeve 132. Sleeve 144 is supported on bearings 146 and 148 for independent rotation relative to the sleeve 132 and keyed shaft 126. Accordingly, the sleeve 144 presents an outer surface 150 for engagement with the associated belt, e.g., 80 (a–e, as the belt is preferably segmented), and that surface is free to rotate faster than the rotational velocity of the shaft 126. In this manner, the greater peripheral speed for accelerating the signature, to provide in turn a sufficient timing gap, is accommodated. Counterweights 152 and 154 are secured to the shaft 126 at opposed ends of the eccentric roll 60. In each case the counterweight is comprised of an eccentric sleeve 156 fitted into close engagement with shaft 126 and secured onto that shaft by a key 158 and lockscrew 160. As is apparent from an examination of FIG. 3, the counterweights 152 and 154 are disposed to locate radial mass generally opposite that of the eccentric sleeve 132; that side of the shaft having the thicker section 138 of the sleeve 132 receives the thinner side of the eccentric sleeves 152 and 154. In this way the shaft may be balanced for high speed rotation on the order of about 2,500 rpm. The individual eccentric rolls may likewise be dynamically balanced by placement of small counterweight slugs in the gap created between the inner and outer sleeves 132 and 144, respectively. Further along these lines, rotational mass effects are sought to be reduced by manufacturing the sleeves 132 and 144 from lightweight materials such as an aluminum alloy, whereas components closer to the rotational axis may be, and preferably are, steel.

In operation, the apparatus 10 which incorporates a sheet diverter in accordance with the present invention is simple yet efficient while providing reliable surface. A ribbon is received within the forming section 12 and folded on the forming board 22 whence it is delivered by the squeeze rolls 24 to the cutting section 16 by means of the main drive rolls of section 14. The counterrotating cutting cylinders 50 and 52 rotate coincidentally with the eccentric counterrotating diverter rolls 58 and 60 by means of timing mechanisms slaving the drive shafts thereof (not shown). Further along these lines, the disposition of the cutting blades or knives 54 and cooperative recesses 56 relative to the reciprocal throw of the diverter rolls is timed so that a signature is formed when the diverter rolls are at a maximum throw either left or right in their travel. That being the case, and by virtue of the generally free-wheeling sleeve 144 of the diverter rolls, the signature is driven into the soft nip of the primary signature control means 70 at an increased velocity, accelerating the trailing edge of that signature away from the leading edge of the next ensuing signature to be cut in stage 16. An increase in speed in the range of about 10–13% is believed to be adequate under most circumstances to yield sufficient separation between signatures for timing the lateral shift of a given signature to one or another of the collation paths 44. As the signature is accelerated through the primary signature control mean 70 and is directed intermediate the counterrotating diverter rolls within the diverter nip 62, these rolls affect lateral placement of the leading edge (e.g. 66) of that signature relative to the apex 116 of the diverter wedge 114, either leftward or rightward thereof as the belts 78 and 80 stretch upon reciprocation and, as a consequence, either open or close the throat regions 122 and 124. As best visualized with reference to FIG. 2, at the instant a signature proceeds through the center line of the axes of the rolls 58 and 60, lying in the diverter plane A—A, the throat 124 opens as the belt 80 is thrust toward its maximum location away from the cooperative diversion surface 120, whereas the throat 122 closes due to the disposition of the diverter belt 78 approaching more closely the cooperative diversion surface 118. The leading edge 66 of the signature 64 preferably is caused to strike the diversion surface at about ¼, but always less than about ⅓, along the length of that diversion surface (e.g. 120) as measured from the apex 116. The smooth, hard surface guides the signature through the throat region into the soft nip of the secondary signature control means, in this instance the control means 74. The signature is grasped within the soft nip prior to the time the trailing edge of the same signature is released by the primary signature control means 70 so that positive control is exerted over the signature throughout its course of travel. The signature is thence routed along the collation path 44 to an appropriate collector 46 which deposits the same on a conveyor 48. The very next signature will reach the diverter guide means 40 as the same is now traversing its path to the left as represented generally by the phantom lines in FIG. 2. The throat 122 in that instance is now opening for receipt of that signature along the diversion surface 118 while the throat 124 is closing. The diverter thus cycles between the respective collation paths to direct sequential signatures to one or the other upon constant circular rotation of the diverter roll means. That uniform circular motion not only leads to shuttling of the diverter nip to direct signature toward a desired path, it does so in such a way to avoid inertial acceleration even at the high speeds involved.

It is plainly apparent from the foregoing detailed description that the sheet diverter of the present invention overcomes many of the problems of the prior art. The instant sheet diverter operates as a pinless folder obviating the waste heretofore attendant conventional folders where signatures are transported through the sheet diverter by means of pins or other elements which mar the marginal edge of the signature. The sheet diverter of the present invention may function efficiently in conjunction with a high speed press printing at sheet speeds in excess of 2,000 feet per minute, up to 2,500 feet per minute or more. Sheets are efficiently diverted into appropriate collation paths at these high speeds with reduced jamming tendencies. Anticipating the occurrence of such jams, which although reduced in tendency could never be made nonexistent, the diverter rolls 58 and 60 may be designed to pivot away from each other slightly in order to open up a region at the throat of the collation paths so an operator can reach into the diverter and retrieve jammed product. Thus, even in the event of jams, the downtime associated with clearing the apparatus is greatly reduced.

While the invention has now been described with reference to various preferred embodiments, those skilled in the art will appreciate that certain substitutions, modifications, changes and omissions may be made without departing from the spirit thereof. Accordingly, the foregoing description is meant to be exemplary only and should not be deemed limitative on the scope of the invention as set forth in the following claims.

I claim:

1. A sheet diverter, adapted for cooperative association with a cutter in a pinless folder assembly wherein a ribbon is cut into a plurality of individual signatures destined for serially deflected parallel collation from a diverter path to a desired one of a plurality of collation paths to systematize the order of said signatures, comprising:

(a) oscillating diverter guide means for directing the lateral disposition of the leading edge of a signature relative to diverter means, wherein said diverter guide means translates over a reciprocable path in a diverter plane having a component generally normal to the diverter path of said signature; and, (b) diverter means separating a plurality of collation paths for deflecting a signature to a selected one thereof, each of said collation paths having a throat partially bounded by said diverter means merging to a confined course for transporting said signature along said collation path.

2. The sheet diverter of claim 1, wherein said diverter guide means are comprised of a pair of diverter rolls journalled for rotation about axes lying in said diverter plane.

3. The sheet diverter of claim 1, wherein said diverter guide means are comprised of counter-rotating eccentric diverter rolls journalled for rotating about axes lying in said diverter plane.

4. The sheet diverter of claim 3 further comprising signature control means for restraining confinement of said signature along said diverter path and into and along a selected one of said collation paths.

5. The sheet diverter of claim 4, wherein said signature control means are comprised of primary signature control means upstream of said diverter guide means and secondary signature control means downstream of each of said throats.

6. The sheet diverter of claim 5, wherein the linear distance through said diverter between said primary signature control means and each of said secondary signature control means is less than the length of the signature to be diverted through said diverter, whereby a respective one of said secondary signature control means assumes control of the leading edge of said signature prior to said primary signature control means releasing control of the trailing edge thereof.

7. The sheet diverter of claim 6, wherein said signature control means include primary, diverter belt means disposed over roll means into operative engagement with said diverter rolls to comprise said diverter path and secondary collator belt means disposed over roll means cooperating with said diverter belt means downstream of each of said throats to comprise said collation path.

8. The sheet diverter of claim 7, wherein each of said primary and secondary signature control means includes a soft nip between associated roll means guiding said belt means.

9. The sheet diverter of claim 8, wherein said primary signature control means is comprised of a soft nip between a superior roll means and an abaxially disposed inferior roll means between which said diverter belt means passes upstream of said diverter rolls and each of said secondary signature control means is comprised of a soft nip between a superior roll means and an abaxially disposed inferior roll means between which an associated one of said collator belt means passes in cooperative engagement with a diverter belt means.

10. The sheet diverter of claim 4, wherein said diverter path is comprised of diverter belt means in operative engagement with said diverter rolls confining said signature therebetween for transport through said diverter guide means and each of said collation paths is comprised of a collator belt for cooperative association with a diverter belt confining said signature therebetween, and further wherein said diverter means is comprised of a diverter wedge means having an apex directed toward the linearly reciprocating bight of said diverter rolls and defining a first throat region between a first sloping diversion surface of said wedge and a diverter belt and a second throat region between a second sloping diversion surface of said wedge and another diverter belt.

11. The sheet diverter of claim 10, wherein said throat regions tend to open and to close as said diverter rolls reciprocate in said diverter plane and thrust said diverter belt means toward and away from said diversion surfaces.

12. The sheet diverter of claim 11, wherein said diverter guide means directs the lateral disposition of said leading edge of said signature into engagement with a desired one of said diversion surfaces at a point lying within about the upper ⅓ of the length of said surface measured from said apex.

13. The sheet diverter of claim 2, wherein a signature severed from said ribbon by said cutter is accelerated relative thereto.

14. The sheet diverter of claim 3, wherein a signature severed from said ribbon by said cutter is accelerated relative thereto.

15. The sheet diverter of claim 4, wherein a signature severed from said ribbon by said cutter is accelerated relative thereto.

16. The sheet diverter of claim 5, wherein a signature severed from said ribbon by said cutter is accelerated relative thereto.

17. The sheet diverter of claim 6, wherein a signature severed from said ribbon by said cutter is accelerated relative thereto.

18. The sheet diverter of claim 7, wherein a signature severed from said ribbon by said cutter is accelerated relative thereto.

19. The sheet diverter of claim 8, wherein a signature severed from said ribbon by said cutter is accelerated relative thereto.

20. The sheet diverter of claim 9, wherein a signature severed from said ribbon by said cutter is accelerated relative thereto.

21. The sheet diverter of claim 14, wherein said cutter is comprised of a pair of counterrotating cutting cylinders and further wherein said diverter rolls are driven synchronously with said cutting cylinders.

22. The sheet diverter of claim 21, wherein each of said diverter rolls is comprised of a shaft securing an eccentric sleeve and an outer sleeve concentric therewith supported on bearing means for independent rotation relative to said shaft.

23. The sheet diverter of claim 22, further comprising timing means for cutting said signature coincident with the maximum throw of said eccentric diverter rolls.

24. A sheet diverter, adapted for cooperative association with a cutter in a pinless folder assembly for a high speed printing press wherein a ribbon is cut into a plurality of individual signatures destined for serially deflected parallel collation from a diverter path to a desired one of a plurality of collation paths to sytematize the order of said signatures, comprising:

(a) a pair of eccentric diverter rolls journalled for rotation and coincident lateral translation in a diverter plane;

(b) a diverter wedge having a generally triangular shape with first and second diversion surface tapering away from an apex directed generally toward said diverter rolls;

(c) first and second diverter belts circulating in separate endless loops through said sheet diverter, lying in generally face-to-face engagement along a diverter path and diverging from a point intermediate said diverter rolls and said diverter wedge along distinct collation paths;

(d) first and second collator belts circulating in separate endless loops, one of each lying in generally face-to-face engagement with one of said diverter belts along said collation paths;

(e) primary signature control means upstream of said diverter rolls, comprising a soft nip capturing said diverter belts along said diverter path; and (f) first and second secondary signature control means downstream of said diverter wedge, each comprising a soft nip capturing one of said diverter belts and an associated one of said collator belts along a collation path.

25. A method for collating signatures delivered from a high speed printing press, comprising the steps of:

(a) delivering a signature to an oscillating diverter guide means translating over a reciprocable path in a plane having a component generally normal to the path of said signature;

(b) guiding the leading edge of said signature laterally into contact with a diverter means; and, (c) directing said signature along said diverter means into a collation path.

26. The method of claim 25, further comprising the step of accelerating said signature throug said diverter guide means.

* * * * *